US007296770B2

(12) United States Patent
Franke

(10) Patent No.: US 7,296,770 B2
(45) Date of Patent: Nov. 20, 2007

(54) ELECTRONIC VITAL RELAY

(75) Inventor: Raymond C. Franke, Glenshaw, PA (US)

(73) Assignee: Union Switch & Signal, Inc., Pittsburgh, PA (US)

( * ) Notice: Subject to any disclaimer, the term of this patent is extended or adjusted under 35 U.S.C. 154(b) by 394 days.

(21) Appl. No.: 11/135,885

(22) Filed: May 24, 2005

(65) Prior Publication Data

US 2006/0266889 A1 Nov. 30, 2006

(51) Int. Cl.
*B61L 21/00* (2006.01)

(52) U.S. Cl. ..... 246/122 R; 246/34 R; 246/130; 246/34 A

(58) Field of Classification Search ..... 246/34 R, 246/35, 36, 37, 40, 34 A, 34 C, 34 CT, 111, 246/114 R, 114 A, 120, 121, 122 R, 122 A, 246/128, 130, 219; 361/160, 170
See application file for complete search history.

(56) References Cited

U.S. PATENT DOCUMENTS 2,537,298 A * 1/1951 Baughman ..... 340/941
2,541,879 A * 2/1951 Martin ..... 361/160
2,887,570 A * 5/1959 Leroy ..... 246/34 R
3,011,050 A * 11/1961 Staples ..... 246/34 R
3,263,074 A * 7/1966 Ihrig ..... 246/34 R
3,287,554 A * 11/1966 Staples ..... 246/35
3,819,933 A * 6/1974 Grundy ..... 246/114 R
4,065,081 A 12/1977 Huffman et al.
4,188,002 A * 2/1980 Gilcher ..... 246/34 R
4,258,312 A 3/1981 Gilcher
4,298,179 A * 11/1981 Gilcher ..... 246/34 R
4,314,306 A * 2/1982 Darrow ..... 361/182
4,407,470 A 10/1983 Gilcher
4,498,650 A 2/1985 Smith et al.
4,535,959 A * 8/1985 Gilcher ..... 246/34 R
4,652,776 A 3/1987 George
4,723,739 A 2/1988 Franke
5,330,134 A * 7/1994 Ehrlich ..... 246/34 R
5,737,173 A * 4/1998 Ross et al. ..... 361/160
6,494,409 B1 12/2002 Franke
6,545,886 B1 4/2003 Ireland

* cited by examiner

*Primary Examiner*—Mark T. Le
(74) *Attorney, Agent, or Firm*—Philip E. Levy; Eckert Seamans Cherin & Mellott, LLC

(57) ABSTRACT

A railroad signaling method includes measuring a track current on a first track section, measuring a local voltage on the railroad line wires, determining whether a magnitude of the track current meets or exceeds a threshold value independent of the local voltage, and determining whether the track current and the local voltage are nominally in phase with one another in a manner that is independent of the track current measuring step. A first signal is provided only if the magnitude is determined to meet or exceed the threshold and the track current and local voltage are determined to be nominally in phase. The first signal is an indication that a train is not present in the track section, that the track section does not have a broken rail, and that the insulated joints that bound the track section do not include a fault condition. An associated relay arrangement is also provided.

21 Claims, 5 Drawing Sheets

ELECTRONIC VITAL RELAY

BACKGROUND OF THE INVENTION

1. Field of the Invention

The present invention relates to signaling system for railroads, and in particular to an electronic vital relay used to detect the presence of a train or a broken rail in particular track sections and/or track fault conditions between track sections.

2. Description of the Prior Art

Railroad systems, such as electrified railroad systems that employ power frequently track circuits, utilize signaling systems to provide signals for train operators and to control the operation of railroad crossing gates and warning lights. In such systems, each track circuit is bounded by insulated joints so that the presence of a train can be defined to a unique section of track. Railroad signaling systems use what is termed a vital relay or track relay to detect the presence of a train or a broken rail in particular track sections and/or track fault conditions between track sections (i.e., a fault in the insulated joint connecting two track sections). The signaling system only permits trains to pass and/or crossing gate and warning light systems to be in an off condition when the relay is in an operated condition. The relay will drop out of an operated condition if a train or a broken rail is in the particular track section being controlled or if there is otherwise a fault on the system which prevents an accurate detection of the presence of a train.

A typical use of a vital relay in a track circuit is shown in FIG. 1. As seen in FIG. 1, a track section T of a stretch of electrified railroad is shown with its rails 1 and 2 illustrated by conventional single line symbols. The rails of section T are electronically insulated from the rails of the adjoining sections by the insulated joints 3, also illustrated by conventional symbols. In order to provide a return circuit for the propulsion current, impedance bond windings 4 are connected across rails 1 and 2 at each end of section T and the associated ends of the adjoining sections. The center taps of each associated pair of bond windings 4 are connected by a lead 5 to provide a conventional circuit path through section T for propulsion current.

The signaling system for this stretch of railroad is based on continuous train detection using a track circuit for each track section such as section T. Signaling energy for the track circuits is provided from a central source S having a frequency of, for example, 50, 60 Hz or 100 Hz, and is distributed along the stretch of railroad by the line wires 6 and 7. Energy is supplied across the rails of section T at the left or transmitting end through a track transformer 8 from the line wires 6 and 7. Even though AC energy is used, the supply connections are such that the instantaneous polarity of the rails on each side of the insulated joints 3 are opposite, as indicated by the polarity markings at the rails 1 and 2. The supply connections include a selected resistor 11 which limits the current flow when a train shunts the rails 1 and 2 at the transmitting end. At the other or receiving end of section T, a vital relay circuit 12 is connected across the rails 1 and 2 through a track transformer 13 and a control coil 14 (alternatively, they may be directly connected) and to the line wires 6 and 7 through a local coil 15. As discussed above, the vital relay circuit 12 detects the presence of a train or a broken rail and/or an insulated joint track fault condition in the section T, which detection is in turn used by the signaling system to provide signals for train operators.

As will be appreciated, if a train is not present and no rail is broken in the section T, a substantial amount of current will be present in the control coil 14. However, if a train is present in the section T, it will shunt the rails 1 and 2, thereby resulting in little or no current in the control coil 14. Similarly, there will be little or no current in the control coil 14 if a rail is broken in the section T. In addition, if the insulating joints 3 are intact, the current in the control coil 14 and the current in the local coil 15 will be substantially in phase. However, if a fault condition develops at the insulating joints 3, the current in the control coil 14 and the current in the local coil 15 will be out of phase. These principles are utilized by vital relays to detect the presence of trains and fault conditions in track sections.

A common type of vital relay in use in electrified railroad systems is what is known as a vane relay. A vane relay operates by a principle similar to that of a watt-hour meter. A vane relay includes a vane positioned in the magnetic gap between two coils (i.e., the control coil 14 and the local coil 15). The vane is responsive to the product of: (i) the current in the control coil, (ii) the current in the local coil, and (iii) the cosine of the angular difference of the current in the two coils. Maximum torque in a first direction is produced in the vane if current of a certain magnitude is present and the angular difference is zero (cosine of 0°=1), and maximum torque is produced in a second, opposite direction if current of a certain magnitude is present and the angular difference is 180° (cosine of 180°=−1). In addition, as the level of current decreases, the level of torque in either direction will decrease. The vane is fitted with a ladder structure so that a multiplicity of electrical contacts will close only when the vane rotates with sufficient torque in the first direction, which proves that the current in the two windings is nominally in phase and the current is of sufficient magnitude, i.e., there is not a train or a broken rail in the track section and there is no insulated joint fault condition. Just as important for railway train detection purposes, the contacts will not close if the phase relationship is reversed (indicates a fault at insulating joints 3), regardless of the magnitude of the product of current and angular difference, or if the current in one of the windings is not of sufficient magnitude (i.e., substantially zero) (indicates the presence of a train or broken rail).

The problem with vane relays is that, as an electromechanical device with moving parts, they require considerable preventive maintenance to assure reliable operation. In addition, because vane relays are a product based device, the control current required to close the contacts is inversely effected by the local voltage. If local voltage regulation is poor, safety or reliable operation can be impacted. For example, if the local voltage decreases, track current decreases proportionally, but the control current required to maintain the track relay energized is increased. In such a situation, the potential exists for the track relay to drop and falsely indicate that the track circuit is occupied. Alternatively, at increased local voltage, the rail current is greater, but the current that is required to maintain the track relay energized is decreased. This increases the risk of the track relay's failure to drop in the presence of a broken rail.

SUMMARY OF THE INVENTION

The present invention relates to a signaling method for a railroad system having a plurality of track sections that are connected to one another. Each of the track sections is bounded on either side by an insulated joint. Signaling energy is provided to the track sections by a source, and the source has line wires connected thereto. The method includes measuring a track current on a first one of the track sections at a first location thereon, wherein the signaling energy is provided to first one of the track sections at a second location thereon. The method further includes measuring a local voltage on the line wires, determining whether a magnitude of the track current meets or exceeds a threshold value independent of the local voltage, and determining whether the track current and the local voltage are nominally in phase with one another in a manner that is independent of the step of determining whether the magnitude of the track current meets or exceeds the threshold value. Finally, the method includes providing a first signal only if the magnitude is determined to meet or exceed the threshold value and the track current and the local voltage are determined to be nominally in phase with one another. The first signal is an indication-that a train is not present in the first one of the track sections, that the first one of the track sections does not have a broken rail, and that the particular insulated joints that bound the first one of the track sections do not include a fault condition. The first signal may cause a relay of the railroad system to be in an operated condition, or, alternatively, the first signal may be provided directly to a signaling system of the railroad system. In the preferred embodiment, the step of determining whether the track current and the local voltage are nominally in phase with one another includes synchronously rectifying the local voltage in response to the phase relationship between the local voltage and the track current.

The present invention also relates to a vital relay arrangement for a railroad system having a plurality of track sections connected to one another. Each of the track sections are bounded by insulated joints. Signaling energy is provided to the track sections by a source having line wires connected thereto. The vital relay arrangement includes a control transformer for generating a track voltage signal that is proportional to a track current on a first one of the track sections at a first location thereon, wherein the signaling energy is provided to the first one of the track sections at a second location thereon, and a local transformer for generating a local voltage signal that is proportional to a local voltage on the line wires. The vital relay arrangement also includes a means for converting the track voltage signal to a DC voltage, a means for determining whether the DC voltage meets or exceeds a voltage threshold value, and a means, independent of the means for determining whether the DC voltage meets or exceeds a voltage threshold value, for determining whether the track voltage signal and the local voltage signal are nominally in phase with one another. The vital relay arrangement provides a first signal only if the DC voltage is determined to meet or exceed the voltage threshold value and the track voltage signal and the local voltage signal are determined to be nominally in phase with one another. The first signal is an indication that a train is not present in the first one of the track sections, that the first one of the track sections does not have a broken rail, and that the particular insulated joints that bound the first one of the track sections do not include a fault condition. Preferably, the means for determining whether the track voltage signal and the local voltage signal are nominally in phase with one another uses synchronous rectification and therefore includes a synchronous rectifier. The synchronous rectifier may include a solid state relay coupled, for example, optically, to a synchronous switching element, wherein the solid state relay receives the track voltage signal and controls the switching of the synchronous switching element based thereon, and wherein the synchronous switching element receives the local voltage signal. The vital relay arrangement also preferably includes an averaging filter that receives the synchronous output voltage signal from the synchronous switching element and produces an averaged output voltage signal that is used to indicate whether the track voltage signal and the local voltage are nominally in phase with one another. The vital relay arrangement may include a relay, wherein the first signal causes the relay to be in an operated condition. Alternatively, the first signal may be provided directly to a signaling system of the railroad system.

BRIEF DESCRIPTION OF THE DRAWINGS

These and other advantages of the present invention will become readily apparent upon consideration of the following detailed description and attached drawings, wherein.

DESCRIPTION OF THE PREFERRED EMBODIMENTS

Figure 1:
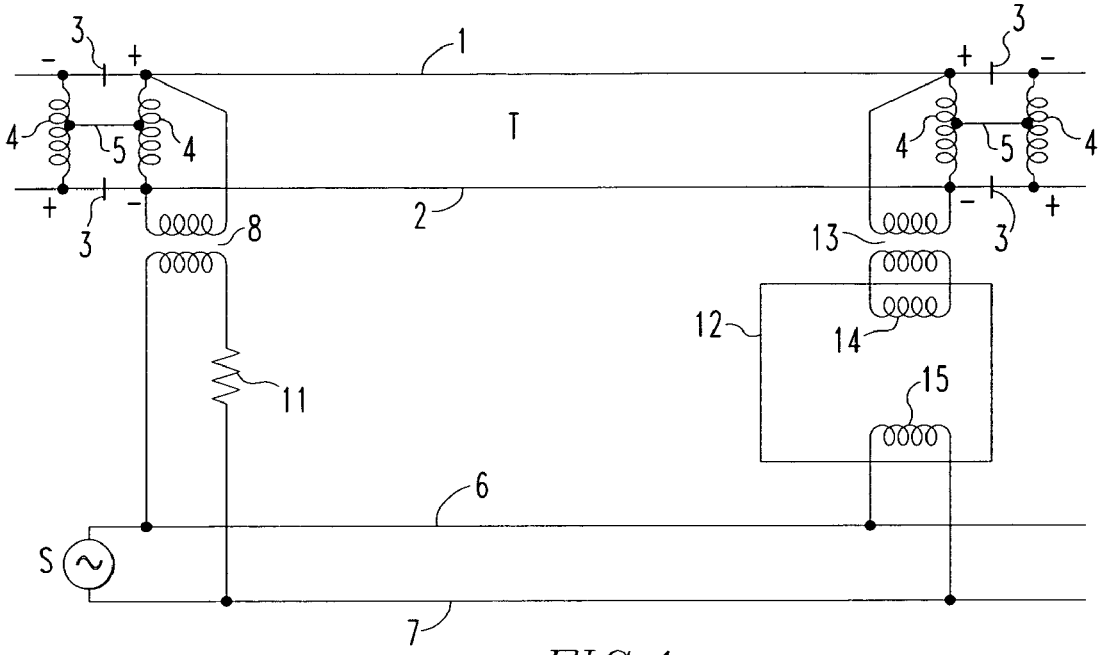
FIG. 1 PRIOR ART
FIG. 1 is a schematic diagram showing a typical use of a vital relay in a track circuit.
Figure 2:
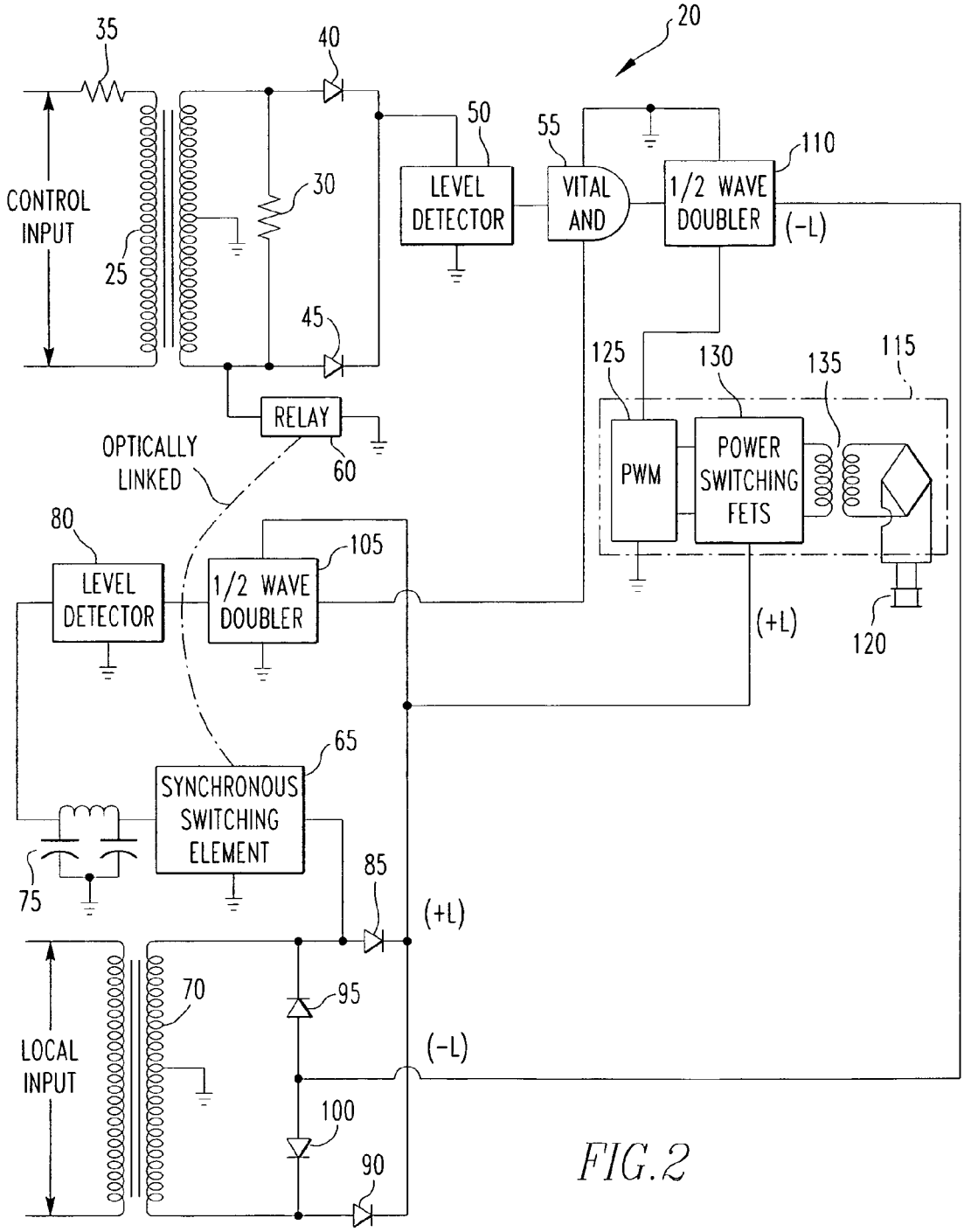
FIG. 2 is a schematic diagram of an electronic vane relay architecture according to the present invention.

FIG. 2 is a schematic diagram of an electronic vane relay architecture 20 according to the present invention. The electronic vane relay architecture 20 may be used in connection with the track configuration shown in FIG. 1, wherein it is the vital relay circuit 12. As described above, a prior art electromechanical vane relay operates by producing torque that drives mechanically linked metallic contacts wherein the torque is proportional to the product of: (i) the current in the local winding, (ii) the current in the control/track winding, and (iii) the cosine of the angular difference of those currents. The current portion of the product is an indication of whether a train or a broken rail is present in the track section being monitored, and the phase portion of the product is an indication of whether a fault condition exists between track sections. In contrast, in electronic vane relay architecture 20, the determination of sufficient current and phase difference for operation of the relay are determined independently from one another in an electronic manner and combined as a logical (digital) AND function to deliver a DC output. In addition, the current determination is based solely on the control/track current, entirely independent of the local voltage.

As seen in FIG. 2, a control transformer 25 (connected to a track transformer such as track transformer 13 in FIG. 1 (not shown)) operates as a current transformer, i.e., it translates the primary track current into a proportional voltage. The transfer function (secondary voltage/primary current) is controlled by the turns ratio of the control transformer 25 and the secondary load provided by resistor 30. To achieve a particular input impedance, such as the input impedance of the vane relays used in many systems (i.e., 62 Ω), a resistor 35 is connected in series with the control transformer 25. Diodes 40 and 45 take the output of the control transformer 25 and produce a DC voltage proportional to the track current. The DC voltage is input into level detector 50. As is known in the art, a level detector is a device that takes a voltage as an input and outputs an oscillating signal, e.g., a square wave, if the input voltage is greater than or equal to a predetermined threshold voltage value, and outputs nothing if the input voltage is less than a predetermined threshold voltage value. Example level detectors are described in U.S. Pat. No. 4,384,250, entitled "Vital Vehicle Movement Detector." and U.S. Pat. No. 4,056,739, entitled "Fail-Safe Electronic Polarized Relay," the disclosures of which are incorporated herein by reference. In the particular embodiment shown in FIG. 2, the predetermined threshold voltage value of level detector 50 is the voltage that is produced by control transformer 25 and diodes 40 and 45 in response to a control current of approximately 50 mA, and the output of level detector 50 when the predetermined threshold value is met or exceeded is a square wave switching at approximately 20 kHz. The output of level detector 50 is provided as one input into optical isolator/vital AND gate 55. The second input into optical isolator/vital AND gate 55 and the output thereof will be described in greater detail herein. However, the important point to note is that the level detector 50 will output an oscillating signal only when the voltage output by control transformer 25 and diodes 40 and 45 meets or exceeds the predetermined threshold voltage value, i.e., when the control/track current meets or exceeds the predetermined threshold voltage value. Those values are chosen to be the values that indicate that a train is not present and there is no broken rail in the track section being monitored by the electronic vane relay architecture 20. Thus, according to this aspect of the invention, the level detector 50 will output an oscillating signal only if there is sufficient current to indicate that neither a train nor a broken rail is present in the track section in question. This is determined by the control/track current and voltage only, and independent of the local voltage.

In addition, the AC voltage output of the control transformer 25 (which is proportional to the control/track current) is input into high speed solid state relay 60. The solid state relay 60 in turn optically transmits a control signal based on the received input voltage signal to synchronous switching element 65. As seen in FIG. 2, electronic vane relay architecture 20 also includes a local transformer 70 (connected to the track supply line wires such as line wires 6 and 7 in FIG. 1 (not shown)) that operates as a step down transformer, i.e., it translates the local voltage into a lower proportional AC voltage. That AC voltage is input into the synchronous switching element 65. Thus, the synchronous switching element 65 has input thereto a control signal that controls the switching of the synchronous switching element 65 based on the AC voltage that is proportional to the control/track current and an AC voltage that is proportional to the local voltage. The solid state relay 60 and the synchronous switching element 65 together operate as a synchronous rectifier. As used herein, the term synchronous rectifier shall refer to a device that takes two AC signals having the same frequency as inputs and outputs a first signal (e.g., half wave rectified) having a first polarity if the signals are in phase and a second signal (e.g., half wave rectified) having a second, opposite polarity if the signals are 180° out of phase. Other phase relationships (e.g., 90° out of phase) will result in a signal of mixed polarity (wherein the average voltage for a 90° out of phase condition will be zero). Thus, synchronous switching element 65 outputs a signal having a first polarity (e.g., positive) if the AC voltage that is proportional to the control/track current and the AC voltage that is proportional to the local voltage are in phase with one another, and a signal having an opposite polarity (e.g., negative) if the AC voltage that is proportional to the control/track current and the AC voltage that is proportional to the local voltage are 180° out of phase with one another. In particular, synchronous switching element 65 includes a switching mechanism that turns on and gates the AC voltage that is proportional to the local voltage through during the positive half cycle of the AC voltage that is proportional to the control/track current, and turns off and gates nothing through during the negative half cycle of the AC voltage that is proportional to the control/track current.

The output of synchronous switching element 65 is input into averaging filter 75. Averaging filter 75 produces a DC output signal that is an average of the AC voltage signal that is input thereto. It should be noted that the inductance value of the inductor forming a part of the averaging filter 75 is extremely high, e.g., on the order of 50-150 Henries. The use of averaging filter 75 is preferred to ensure that level detector 80, described below, responds only if the synchronous switching element 65 is operating properly. If a peak filter (simple capacitor) were used instead, a sequence of component failures could satisfy the level detector 80 regardless of phase differential between the control/track current and the local voltage. Of chief concern is a series of component failures, each of which is undetectable, followed by a shorted synchronous switching element 65, the consequence being continued operation regardless of phase reversal and therefore continued operation of the output in the event of a failed insulated joint.

The voltage signal output by the averaging filter 75 is input into level detector 80. As described above in connection with level detector 50, level detector 80 will output an oscillating signal, e.g., a square wave, only when the voltage output by averaging filter 75 meets or exceeds a predetermined threshold voltage value, and will output nothing if the voltage output by averaging filter 75 is less than the predetermined threshold voltage value (including negative values). The predetermined threshold voltage value is chosen to correspond to the voltage that would be output by averaging filter 75 in cases where the AC voltage that is proportional to the control/track current and the AC voltage that is proportional to the local voltage are nominally in phase, meaning they are in phase within a particular predetermined amount. For example, the AC voltage that is proportional to the control/track current and the AC voltage that is proportional to the local voltage may be considered to be nominally in phase when they are at least within 45° of one another. Such tolerance to phase shift is necessary because in operation, the control input will typically lag the local input due to the inductance of the rails. Thus, as will be appreciated, level detector 80 will output an oscillating signal only when the AC voltage that is proportional to the control/track current and the AC voltage that is proportional to the local voltage are nominally in phase, because it is only then that output of synchronous switching element 65 and averaging filter 75 will output a positive polarity signal of sufficient magnitude.

Diodes 85, 90, 95 and 100 are coupled to local transformer 65 as shown in FIG. 2. Diodes 85, 90, 95 and 100 produce positive and negative rectified (DC) voltage sources (+L) and (−L).

The output level detector 80 and positive source +L are input into a half-wave doubler circuit 105. As is known in the art, a half-wave doubler circuit receives a DC source voltage and produces a DC output voltage of polarity opposite (the magnitude may differ) to that of its source voltage only if it also receives a second, oscillating input such as a square wave input. If either the source voltage or the oscillating input is missing, the half-wave doubler circuit outputs nothing. Essentially, a half-wave doubler circuit functions as a fail-safe AND gate, i.e. it produces an opposite polarity output only with an oscillating input AND an applied source voltage. Both inputs, oscillating and source voltage, are required for an opposite polarity output.

Figure 3A:
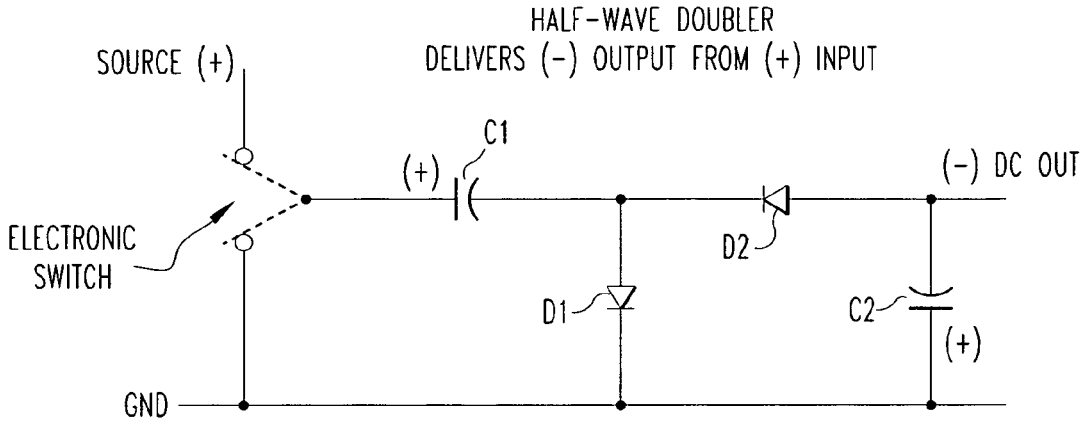
FIGS. 3A and 3B are schematic diagrams of example half-wave doubler circuit implementations.
Figure 3B:
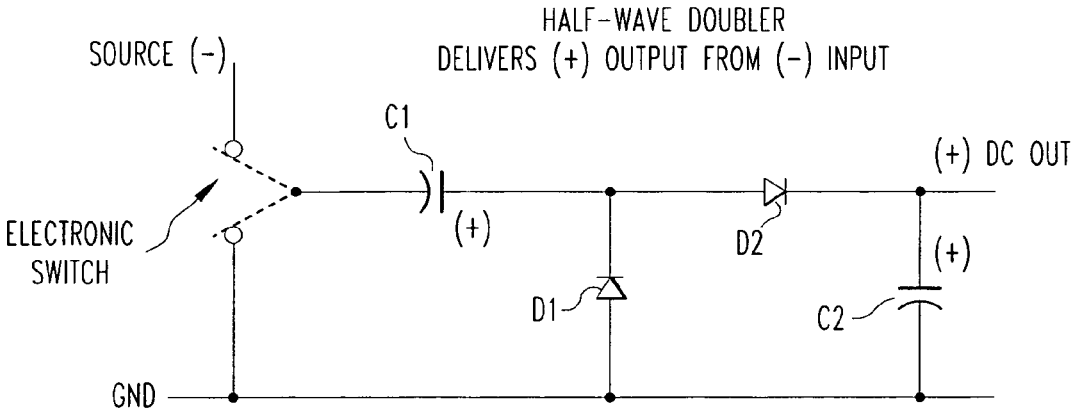

With only one of the two inputs, no component or combination of component failures can produce an opposite polarity output. Examples of suitable half wave doubler circuits for use in the present invention are shown in FIGS. 3A and 3B.

Thus, in FIG. 2, half-wave doubler circuit 105 will output a negative polarity voltage signal only if it receives an oscillating signal from level detector 80. As noted above, level detector 80 will output an oscillating signal only when the AC voltage that is proportional to the control/track current and the AC voltage that is proportional to the local voltage are in phase. Thus, the output of half-wave doubler circuit 105 is an indicator of the phase relationship between the control/track current and the local voltage, i.e., if a negative polarity voltage signal is present at the output of the half-wave doubler circuit 105, it means the two currents are nominally in phase.

The output of half-wave doubler circuit 105 is input into optical isolator/vital AND gate 55. As noted above, optical isolator/vital AND gate 55 also receives the output of level detector 50. The optical isolator/vital AND gate 55 will output an oscillating signal only if: (i) the output of level detector 50 is an oscillating signal (meaning that the control/track current has been determined to be of sufficient magnitude to indicate that no train is present and not rail is broken), AND (ii) the output of half-wave doubler circuit 105 is a negative polarity voltage signal (meaning that the control/track current and local voltage are nominally in phase and thus there is not an insulated joint fault condition); if either signal is missing, then optical isolator/vital AND gate 55 outputs nothing.

The output of optical isolator/vital AND gate 55 is input into half-wave doubler circuit 110. Also input into the half-wave doubler circuit 110 is the negative source (−L) generated by diodes 85, 90, 95 and 100. The half-wave doubler circuit 110 will output a positive polarity signal only if the input it receives from optical isolator/vital AND gate 55 is an oscillating signal. Thus, a positive polarity signal output from the half-wave doubler circuit 110 proves that the control/track current is greater than the predetermined threshold value (e.g., 50 mA) and that the local AND control/track currents are nominally in phase. Because control/track input current magnitude and phase comparison are independently determined according to the present invention, sensitivity to control/track current is not influenced by phase or magnitude of the local input.

The output of the half-wave doubler circuit 110 may be used directly as an input to the railroad signaling system in question, wherein it acts as the vital relay output. However, in most applications, the output of the half-wave doubler circuit 110 is not of sufficient power for that purpose. Thus, as an alternative, as shown in FIG. 2, the output of the half-wave doubler circuit 110 may be input into output circuitry 115 that acts as a power conversion circuit for driving relay 120, such as a PN-150 relay manufactured by the assignee of the present invention. The output circuitry 115 includes pulse width modulator 125 and power switching FETs 130 that drive a transformer 135. Output of half-wave doubler #1 furnishes the control voltage to the 1524 control chip; it produces the gate signals that alternately turn on the FETs driving the transformer. In this case, the output power of the half-wave doubler circuit 110 is insufficient to also act as the source for the power switching FETs 130, and therefore the positive source +L is used as the source for the power switching FETs 130.

Figure 4A:
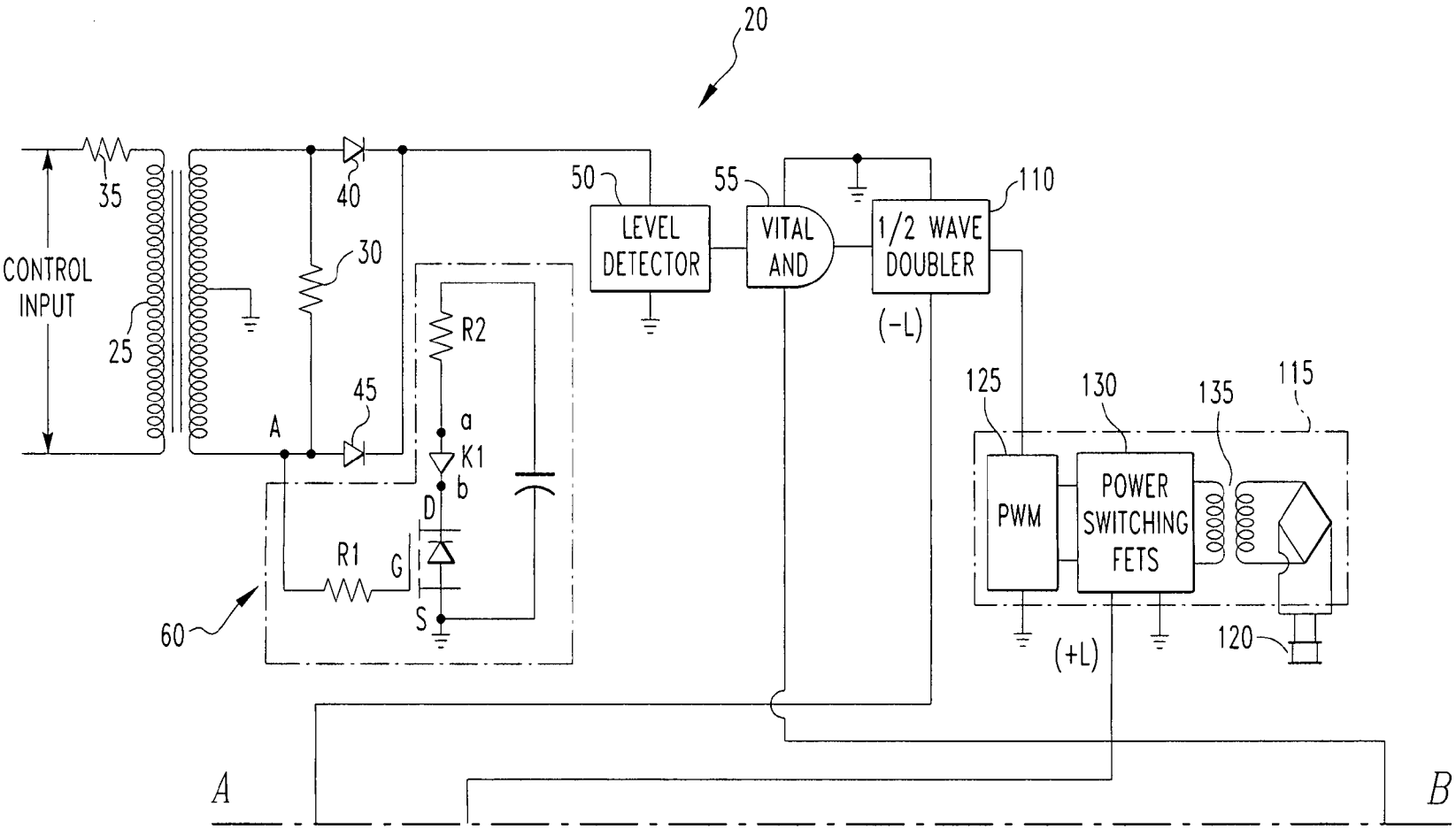
FIGS. 4A and 4B are a schematic diagram of one particular embodiment of the electronic vane relay of FIG. 2.
Figure 4B:
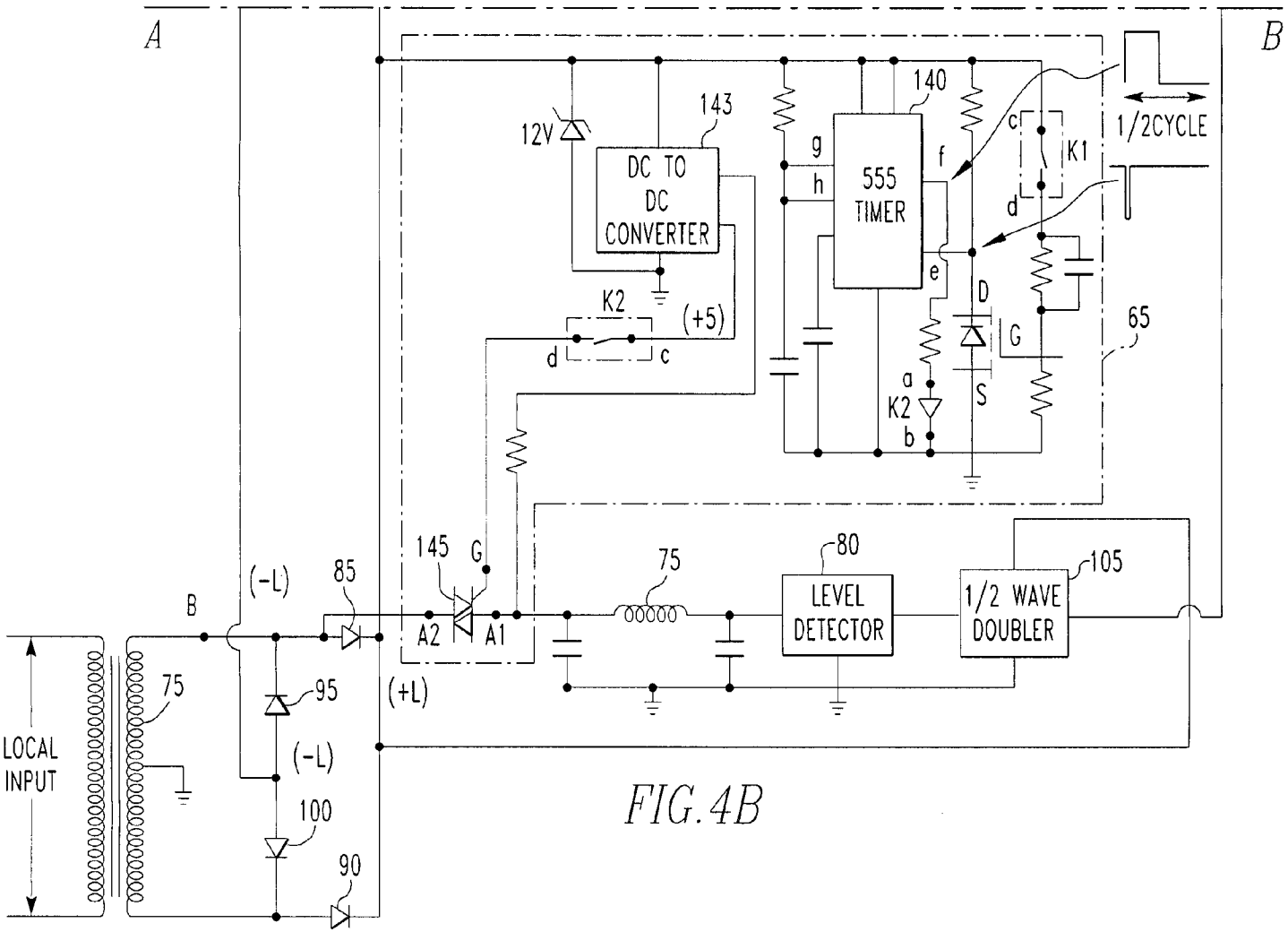

FIGS. 4A and 4B are a schematic diagram of the electronic vane relay architecture 20 according to one particular embodiment of the present invention. Specifically, FIGS. 4A and 4B show one particular implementation of the solid state relay 60 and the synchronous switching element 65. The elements identified as K1 and K2 are solid state relays, such as the model AQV225 relay sold by Aromat Corporation of New Providence, New Jersey. Switching speed is preferably on the order of about 100 microseconds. A diode symbol bounded by terminals a and b is intended as a representation of the control element, and the mechanical switch enclosed in the dashed box is intended as a representation of the switching element (pseudo contacts). Current through terminals a and b effectively produces a low resistance connection from terminals c to d. The control element and the switching element (pseudo contacts) share no common connection; they are isolated, being optically coupled.

On each positive excursion at A of the control transformer 25, the pseudo contact of K1 closes and a 200 microsecond negative going pulse is delivered to terminal e of the 555 timer 140. In response, its output on pin f switches high for a much greater time, controlled by the resistor and capacitor connected to pins g & h. Additionally, the pseudo contacts of K2, coupled to 12V to 5V DC to DC converter 143, close and gate the triac 145 ON. The time is set to approximately 75% of one half the period of the operating frequency. For example, for 50 or 60 Hz applications, the time is set to approximately 6 milliseconds, and for 100 Hz applications, the time is set to approximately 3 milliseconds. It is expected B of the local transformer 75 is nominally in phase with A of the control transformer 25 and therefore the triac 145 is turned ON for a substantial portion of time during which A and B are simultaneously positive. It is important that the gate of the triac 145 be switched OFF before the negative half-cycle of A is initiated otherwise it will remain ON continuously and disrupt the synchronous rectification process. Limiting ON time of the gate of the triac 145 also allows for a moderate amount of phase shift of local with respect to control. By limiting the ON time of the gate of the triac 145 to 75% of one-half the period of the operating frequency, a phase shift of approximately 45 degrees can be tolerated. In track circuit operation, the control input will lag local due to inductance of the rails, and therefore, tolerance to phase shift is necessary. Thus, if A and B are nominally in phase, a positive voltage the level detector 80 and the half-wave doubler 105, thereby producing a negative polarity voltage signal that, as discussed above in connection with FIG. 2, confirms the phase relationship of A and B.

If A and B are out of phase, meaning they are not nominally in phase, which can occur resulting from a failed insulated joint 3, synchronous rectification will produce a negative voltage. The level detector 80 will not respond to a negative voltage and thus the failed insulated joint 3 is detected because the relay 120 will de-energize.

It is shown that synchronous rectification is critical to the task of ensuring that local and control are essentially in phase but it is of great importance to ensure no component failures can mask the in phase relationship. For example, if the triac 145 or gate control thereof fails and the triac 145 is either shorted or ON continuously, the voltage at A1 will revert to a sine wave instead of half-wave rectification. In that event, the averaging filter 75 will average the input to the level detector 80 to zero volts; the level detector 80 will not respond and the relay 120 will de-energize. The averaging filter 75 was selected instead of a peak filter because its failure modes preclude the possibility of continued operation with a series of component failures.

Peak filtering is realized with a single capacitor. Under normal conditions, a peak filter will produce a much greater voltage than an averaging filter like averaging filter 75. However, the level detector 80 can be scaled to operate at a significantly greater voltage and, therefore, a peak filter could operate just as well. Sequential component failures are undetectable, however, and can result in inability to detect phase reversal as the result of a failed insulated joint 3. With a single capacitor, if either connection opens, the level detector 80 input will revert to positive half sine wave DC pulses. The level detector 80 will respond with an output approximately one-half the time corresponding to each input pulse. The pulsating response will ripple through to the final output stage (115), producing reduced voltage to the relay 120, but still sufficient to retain the relay 120 in an energized state. Thus, an open lead to the peak filter capacitor is undetectable. Subsequently, if the triac 145 or control thereof fails and it is continuously in conduction, the level detector 80 will continue its pulsating response with the relay 120 held energized. If phase reversal then occurs as a result of a failed insulated joint 3 it will be undetected and jeopardize integrity of the signal system.

With the averaging filter 75, disconnection of either capacitor thereof decreases the voltage to the level detector 80 and response to an AC input averages an output to zero. If both capacitors open, the net DC that is produced will decrease, but the level detector 80 will marginally continue to function. Thereafter, if the triac 145 shorts, it will provide an AC input to the averaging filter 75, which in turn will produce an output that is well blow the level required by level detector 80 (it will be at or near zero). The failure of triac 145 is thus detectable.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the breadth of the claims appended in any and all equivalents thereof.

What is claimed is:

1. A signaling method for a railroad system having a plurality of track sections connected to one another, each of the track sections being bounded by insulated joints, wherein signaling energy is provided to said track sections by a source, said source having line wires connected thereto, the method comprising:

measuring a track current on a first one of said track sections at a first location on said first one of said track sections, said signaling energy being provided to said first one of said track sections at a second location on said first one of said track sections;

measuring a local voltage on said line wires;

determining whether a magnitude of said track current meets or exceeds a threshold value independent of said local voltage;

determining whether said track current and said local voltage are nominally in phase with one another in a manner that is independent of said step of determining whether the magnitude of said track current meets or exceeds said threshold value; and providing a first signal only if said magnitude is determined to meet or exceed said threshold value and said track current and said local voltage are determined to be nominally in phase with one another; said first signal being an indication that a train is not present in said first one of said track sections, that said first one of said track sections does not have a broken rail, and that the particular ones of said insulated joints that bound said first one of said track sections do not include a fault condition.

2. The method according to claim 1, wherein said first signal causes a relay of said railroad system to be in an operated condition.

3. The method according to claim 1, wherein said providing step comprises providing said first signal directly to a signaling system said railroad system.

4. The method according to claim 1, wherein said step of determining whether said track current and said local voltage are nominally in phase with one another includes synchronously rectifying said local voltage in response to a phase relationship between said local voltage and said track current.

5. The method according to claim 4, wherein said step of determining whether said track current and said local voltage are nominally in phase with one another includes translating said track current into a track voltage signal that is proportional to said track current and translating said local voltage into a local voltage signal that is proportional to said local voltage and wherein said step of synchronously rectifying said local voltage in response to a phase relationship between said local voltage and said track current includes synchronously rectifying said local voltage signal in response to a phase relationship between said local voltage signal and said track voltage signal.

6. The method according to claim 5, wherein said step of synchronously rectifying said local voltage in response to a phase relationship between said local voltage and said track current produces a synchronous output voltage signal, the method further comprising averaging said synchronous output voltage signal to produce an averaged output voltage signal and using said averaged output voltage signal to indicate whether said track current and said local voltage are nominally in phase with one another.

7. The method according to claim 1, wherein said step of determining whether a magnitude of said track current meets or exceeds a threshold value includes translating said track current into a track voltage signal that is proportional to said track current, converting said track voltage signal into a proportional DC voltage, and determining whether said DC voltage meets or exceeds a voltage threshold value.

8. The method according to claim 6, wherein said step of determining whether a magnitude of said track current meets or exceeds a threshold value includes translating said track current into a track voltage signal that is proportional to said track current, converting said track voltage signal into a proportional DC voltage, and determining whether said DC voltage meets or exceeds a voltage threshold value.

9. The method according to claim 8, further comprising generating a second signal only if it is determined that said DC voltage meets or exceeds said voltage threshold value, wherein said step of using said averaged output voltage signal to indicate whether said track current and said local voltage are nominally in phase with one another includes generating a third signal only if said averaged output voltage signal indicates that said track current and said local voltage are nominally in phase with one another, said providing step comprising providing said first signal only if it is determined that said second and third signals are present.

10. The method according to claim 5, wherein said step of determining whether a magnitude of said track current meets or exceeds a threshold value includes translating said track current into a track voltage signal that is proportional to said track current, converting said track voltage signal into a proportional DC voltage, and determining whether said DC voltage meets or exceeds a voltage threshold value.

11. The method according to claim 10, wherein said step of synchronously rectifying said local voltage in response to a phase relationship between said local voltage and said track current produces a synchronous output voltage signal, the method further comprising generating a second signal only if it is determined that said DC voltage meets or exceeds said voltage threshold value and generating a third signal only if said synchronous output voltage signal indicates that said track current and said local voltage are nominally in phase with one another, said providing step comprising providing said first signal only if it is determined that said second and third signals are present.

12. A vital relay arrangement for a railroad system having a plurality of track sections connected to one another, each of the track sections being bounded by insulated joints, wherein signaling energy is provided to said track sections by a source, said source having line wires connected thereto, comprising:

a control transformer for generating a track voltage signal, said track voltage signal being proportional to a track current on a first one of said track sections at a first location on said first one of said track sections, said signaling energy being provided to said first one of said track sections at a second location on said first one of said track sections;

a local transformer for generating a local voltage signal, said local voltage signal being proportional to a local voltage on said line wires:

means for converting said track voltage signal to a DC voltage;

means for determining whether said DC voltage meets or exceeds a voltage threshold value; and means, independent of said means for determining whether said DC voltage meets or exceeds a voltage threshold value, for determining whether said track voltage signal and said local voltage signal are nominally in phase with one another;

wherein said vital relay arrangement provides a first signal only if said DC voltage is determined to meet or exceed said voltage threshold value and said track voltage signal and said local voltage signal are determined to be nominally in phase with one another, said first signal being an indication that a train is not present in said first one of said track sections, that said first one of said track sections does not have a broken rail, and that the particular ones of said insulated joints that bound said first one of said track sections do not include a fault condition.

13. The vital relay arrangement according to claim 12, wherein said means for determining whether said track voltage signal and said local voltage signal are nominally in phase with one another includes a synchronous rectifier.

14. The vital relay arrangement according to claim 13, wherein said synchronous rectifier includes a solid state relay coupled to a synchronous switching element, said solid state relay receiving said track voltage signal and controlling the switching of said synchronous switching element based thereon, said synchronous switching element receiving said local voltage signal.

15. The vital relay arrangement according to claim 14, wherein said solid state relay is optically coupled to said synchronous switching element, and wherein control signals are optically transmitted from said solid state relay to said synchronous switching element.

16. The vital relay arrangement according to claim 13, wherein said synchronous rectifier produces a synchronous output voltage signal, the vital relay arrangement further comprising an averaging filter, wherein said averaging filter receives said synchronous output voltage signal and produces an averaged output voltage signal, said averaged output voltage signal being used to indicate whether said track voltage signal and said local voltage are nominally in phase with one another.

17. The vital relay arrangement according to claim 12, wherein said means for determining whether said DC voltage meets or exceeds a voltage threshold value includes a level detector.

18. The vital relay arrangement according to claim 13, wherein said means for determining whether said DC voltage meets or exceeds a first voltage threshold value includes a first level detector, said first level detector producing a first oscillating signal only if said DC voltage meets or exceeds said first voltage threshold value, and wherein said synchronous rectifier produces a synchronous output voltage signal, the vital relay arrangement further comprising:

an averaging filter, wherein said averaging filter receives said synchronous output voltage signal and produces an averaged output voltage signal;

a second level detector, wherein said second level detector receives said averaged output voltage signal and produces a second oscillating signal only if said averaged output voltage signal exceeds a second voltage threshold value; and a first half-wave doubler, said first half-wave doubler producing a second signal only if said first half-wave doubler receives said oscillating signal produced by said first level detector;

wherein said vital relay arrangement provides said first signal only if it is determined that said first oscillating signal and said second signal are present.

19. The vital relay arrangement according to claim 18, further comprising a relay, wherein said first signal causes said relay to be in an operated condition.

20. The vital relay arrangement according to claim 18, wherein said first signal is provided directly to a signaling system of said railroad system.

21. The vital relay arrangement according to claim 18, further comprising an optical isolator/vital AND gate and a second half-wave doubler, said optical isolator/vital AND gate producing a third oscillating signal only if said optical isolator/vital AND gate receives said first oscillating signal and said second signal, said second half-wave doubler producing said first signal only it said second half-wave doubler receives said third oscillating signal.

* * * * *